US007175882B2

(12) United States Patent
Dolan et al.

(10) Patent No.: US 7,175,882 B2
(45) Date of Patent: Feb. 13, 2007

(54) PROCESS FOR COATING METAL SURFACES

(75) Inventors: Shawn E. Dolan, Sterling Heights, MI (US); Lawrence R. Carlson, Oxford, MI (US)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 10/398,002

(22) PCT Filed: Oct. 1, 2001

(86) PCT No.: PCT/US01/30571

§ 371 (c)(1),
(2), (4) Date: Aug. 25, 2003

(87) PCT Pub. No.: WO02/28549

PCT Pub. Date: Apr. 11, 2002

(65) Prior Publication Data

US 2004/0025973 A1 Feb. 12, 2004

Related U.S. Application Data

(60) Provisional application No. 60/237,289, filed on Oct. 2, 2000.

(51) Int. Cl.
*B05D 1/36* (2006.01)
*B05D 7/14* (2006.01)

(52) U.S. Cl. ..... 427/327; 427/376.1; 427/402; 427/419.1; 428/649; 428/650; 428/658

(58) Field of Classification Search ..... 427/327, 427/376.1, 402, 419.1; 106/14.12; 428/650, 428/649, 658
See application file for complete search history.

(56) References Cited

U.S. PATENT DOCUMENTS

| | | | | |
|---|---|---|---|---|
| 4,264,378 A | | 4/1981 | Oppen et al. | 148/6.15 |
| 4,992,115 A | * | 2/1991 | Ikeda | 148/247 |
| 5,281,282 A | | 1/1994 | Dolan et al. | 148/247 |
| 5,342,456 A | | 8/1994 | Dolan | 148/247 |
| 5,356,490 A | | 10/1994 | Dolan et al. | 148/249 |
| 5,427,632 A | | 6/1995 | Dolan | 148/259 |
| 5,449,414 A | | 9/1995 | Dolan | 148/247 |
| 5,449,415 A | | 9/1995 | Dolan | 148/259 |
| 5,534,082 A | | 7/1996 | Dollman et al. | 148/247 |
| 5,759,244 A | | 6/1998 | Tomlinson | 106/14.14 |
| 5,769,967 A | | 6/1998 | Dolan | 148/247 |
| 5,843,242 A | * | 12/1998 | Dolan | 148/272 |
| 5,885,373 A | | 3/1999 | Sienkowski | 148/247 |
| 5,952,049 A | | 9/1999 | Tomlinson | 427/327 |
| 5,958,511 A | | 9/1999 | Dolan | 427/258 |
| 5,993,567 A | | 11/1999 | Dolan | 148/247 |
| 6,083,309 A | | 7/2000 | Tomlinson | 106/14.21 |
| 6,193,815 B1 | | 2/2001 | Wada et al. | 148/247 |
| 6,315,823 B1 | | 11/2001 | Dolan | 106/14.21 |

FOREIGN PATENT DOCUMENTS

| | | |
|---|---|---|
| JP | 56136978 | 10/1981 |
| WO | WO9851841 | 11/1989 |
| WO | WO0022188 | 10/1999 |

OTHER PUBLICATIONS

Derwent Abstract of SU 1578237 by Fokin et al., Jul. 15, 1990.*
JP 56-136978 Abstract.
SU 1578237 A; Jul. 15, 1990; abstract.

* cited by examiner

*Primary Examiner*—Kirsten Jolley
(74) *Attorney, Agent, or Firm*—Stephen D. Harper; Mary K. Cameron

(57) ABSTRACT

A protective coating is formed on a metallic surface by contacting the surface with an aqueous solution of fluorometallate followed by an aqueous solution containing vanadate ions. The process does not require the use of any organic substances, but provides a corrosion resistant surface having good heat conductivity.

21 Claims, No Drawings

PROCESS FOR COATING METAL SURFACES

This application is the National Stage of International Application No. PCT/US01/30571, filed 1 Oct. 2001, and published in English, from which priority is hereby claimed, as well as from U.S. Provisional Application Ser. No. 60/237,289, filed 2 Oct. 2000, which is the priority document for International Application No. PCT/US01/30571.

BACKGROUND OF THE INVENTION

This invention relates to processes for forming a protective coating on metal, particularly on: zinc, aluminum, magnesium, and/or zinc, magnesium, and/or aluminum alloy, more particularly aluminum and/or aluminum alloy surfaces. The invention is more particularly related to protective coatings that do not, in contrast to most protective coatings on metals, incorporate any substantial amounts of organic chemical substance. This type of coating is particularly useful for, but is not restricted to, use in heat exchanger surfaces, in which a substantially organic coating layer would impede heat transfer. However, the invention is also applicable to forming a completely inorganic intermediate coating which can then be further coated with other materials, including organic ones such as paint.

Most prior art protective coatings for metals, even in those applications in which heat conduction across the metal surface must be preserved, have required at least one of hexavalent chromium or organic substances to obtain high quality protection. Because of its hazard to workers who come into contact with it and to the general environment, the use of hexavalent chromium is increasingly being economically penalized, or even legally proscribed, in most parts of the world. While most organic substances used in coatings have no such hazardous properties, they do have the disadvantages of often being at least one of expensive, low in heat conductivity, susceptible to damage by heat, and difficult to manage for consistent results in long-continued use when mixed with inorganic materials, as they usually must be to obtain good protection in at least one of the stages of a complete protective coating for metal.

Accordingly, a major object of this invention is to provide a process for forming completely inorganic and hexavalent-chromium-free coatings on metals that will have a protective value at least as good as those now in commercial use for heat exchanger surfaces. Preferably, the coatings provided by the invention will also be at least one of low in cost, easy to manage in long continued use, easily wet by water (i.e., have a low contact angle with water), and high in heat conductivity. Other alternative, concurrent, and/or more detailed objectives will become apparent from the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout the description, unless expressly stated to the contrary: percent, "parts of", and ratio values are by weight or mass; the term "polymer" includes "oligomer", "copolymer", "terpolymer" and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not preclude unspecified chemical interactions among the constituents of a mixture once mixed; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise such counterions may be freely selected, except for avoiding counterions that act adversely to an object of the invention; the word "mole" means "gram mole", and the word itself and all of its grammatical variations may be used for any chemical species defined by all of the types and numbers of atoms present in it, irrespective of whether the species is ionic, neutral, unstable, hypothetical, or in fact a stable neutral substance with well defined molecules; the term "paint" and all of its grammatical variations include all materials known by more specialized names such as "lacquer", "varnish", "shellac", "primer", "electropaint", "top coat", "color coat", "clear coat", "autodeposited coatings", "radiation curable coatings", "cross-linkable coatings", and the like and their corresponding grammatical variations; and the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained within the range of 18–25° C.

BRIEF SUMMARY OF THE INVENTION

It has been found that a surprisingly simple, two-operation process is capable of developing on metals a strongly corrosion resistant surface that has good heat conductivity. In the first essential operation of a process according to the invention, the metal surface is reacted with an aqueous solution of at least one fluorometallic acid and/or fluorometallate salt, and in the second essential operation of a process according to the invention, the surface formed on the metal substrate by reaction with the aqueous solution of flurorometallic acid is further reacted with an aqueous solution of a vanadate salt. A broader process according to the invention may include other operations, and these other operations per se may be known from prior art. Articles of manufacture that include a substrate metal treated by a process according to the invention are an alternative embodiment of the invention.

DETAILED DESCRIPTION OF THE INVENTION AND PREFERRED EMBODIMENTS

Before a substrate undergoes the first essential operation of a process according to the invention, the substrate is preferably clean, and if the substrate is one of the metals such as aluminum and magnesium that are prone to spontaneous formation of thick oxide layers on their surfaces, it should also be deoxidized by processes known per se in the prior art, or other suitable processes. Preferred deoxidizing processes are described in the examples below. Cleaning may be accomplished by means already known in the art, based on the particular metal substrate being treated. For example, if the substrate is aluminum intended for heat exchanger functions as is most preferred, the substrate preferably is cleaned with a commercial aqueous alkaline cleaner for aluminum, rinsed, deoxidized, and again rinsed before undergoing the first essential operation of a process according to the invention.

The first essential operation of a process according to this invention is contacting a metal substrate to be coated with a first treatment liquid comprising, preferably consisting essentially of, or more preferably consisting of, water and "fluorometallate", fluorometallate being defined as all substances with molecules corresponding to the following general empirical chemical formula (I):

$$H_pT_qF_rO_s \quad \text{(I)},$$

wherein: each of p, q, r, and s represents a non-negative integer; T represents a chemical atomic symbol selected from the group consisting of Ti, Zr, Hf, Si, Al, and B; r is at least 4; q is at least 1 and preferably is not more than, with increasing preference in the order given, 3, 2, or 1; unless T represents B, (r+s) is at least 6; s preferably is not more than, with increasing preference in the order given, 2, 1, or 0; and (unless T represents A1) p preferably is not more than (2+s). (All the preferences stated in the immediately preceding sentence are preferred independently of one another.) The fluorometallate more preferably is selected from the group consisting of hexafluorotitanic acid, hexafluorozirconic acid, and the water soluble salts of both of these acids. Hexafluorozirconic acid and its salts are most preferred. Independently, at least for economy, acids are usually preferred over their salts as the source of any fluorometallate sourced to a first treatment liquid in a process according to this invention.

The first treatment liquid in a process according to this invention optionally contains one or both of: (i) hydrofluoric acid and/or its salts, in a sufficient amount to minimize decomposition of the fluorometallate component; and/or (ii) another acidizing or alkalinizing agent as needed to result in a pH value for the first treatment liquid that is at least, with increasing preference in the order given, 1.0, 1.5, 2.0, 2.5, 3.0, 3.2, 3.4, 3.6, 3.8, or 4.0 and independently preferably is not more than, with increasing preference in the order given, 8.0, 7.0, 6.0, 5.5, 5.0, 4.8, 4.6, 4.4, or 4.2. When an alkalinizing agent is needed to adjust the pH, as is most common if acid is used to supply the fluorometallate, aqueous ammonia is most preferably used as the alkalinizing agent.

The preferable concentration of the fluorometallate component is specified in terms of millimoles of the element(s) represented by T in general formula (I) above in each kilogram of the first treatment, and this concentration unit is hereinafter usually abbreviated as "mM/kg". In a working composition according to the invention, this concentration preferably is at least, with increasing preference in the order given, 0.7, 1.5, 2.0, 2.5, 3.0, 3.5, 4.0, 4.5, 5.0, 5.4, or 5.7 mM/kg and independently, at least for economy preferably is not more than, with increasing preference in the order given, 100, 75, 50, 40, 30, 25, 20, 15, 12, 10, 8, 7.1, 6.9, 6.7, 6.5, 6.3, 6.1, or 5.9 mM/kg.

Many fluorometallates are susceptible to slow spontaneous decomposition to water insoluble oxides of the element represented by the symbol T in general formula (I). Such decomposition is particularly likely with the preferred fluorometallates that contain no oxygen and have an atomic ratio of fluorine to T of 6. In order to minimize such decomposition in a first treatment liquid as described above in which most or all of the fluorometallate content has no oxygen and has an F:T atomic ratio of 6, it is preferable for the first treatment liquid to include additional dissolved fluoride from another source than fluorometallate in an amount such that the F:T ratio for the first treatment liquid overall is at least, with increasing preference in the order given, 6.02:1.00, 6.04:1.00, 6.06:1.00, 6.08:1.00, 6.10:1.00, or 6.12:1.00. Most commercial sources of hexafluorosilicic, hexafluorotitanic, and hexafluorozirconic acids are supplied with sufficient additional fluoride to fall within these preferences, so that when a first treatment liquid as described above is prepared with such sources of fluorometallates, it is not usually necessary to add additional fluoride from any other source.

While small amounts of additional dissolved fluoride are desirable as described above, larger amounts can cause difficulties from excessive etching of the substrate to be coated and/or corrosion of equipment in contact with the first treatment liquid. For these reasons, the overall atomic ratio of F:T in a first treatment liquid as described above preferably is not more than, with increasing preference in the order given, 9.0:1.00, 8.0:1.00, 7.5:1.00, 7.0:1.00, 6.7:1.00, 6.4:1.00, 6.35:1.00, or 6.30:1.00.

For a variety of reasons, some of which have already been given above, it is preferred that a first treatment liquid to be used in the first essential operation of a process according to the invention should be substantially free from many ingredients used in compositions for similar purposes in the prior art. Specifically and independently for each preferably minimized component listed below, it is preferred that a first liquid treatment as described above should contain no more than, with increasing preference in the order given, 1.0, 0.35, 0.10, 0.08, 0.04, 0.02, 0.01, 0.001, or 0.0002 percent of any of the following constituents: (i) organically bonded carbon and (ii) any element having an atomic number that is greater than 14, except for an element that is part of a fluorometallate as described above or is an alkali metal or alkaline earth metal. It is more particularly preferred that a first liquid treatment as described above should contain no more than, with increasing preference in the order given, 1.0, 0.35, 0.10, 0.08, 0.04, 0.02, 0.01, 0.001, or 0.0002 percent of each of the following constituents: phosphate anions; hexavalent chromium; zinc, nickel, copper, manganese, and cobalt cations; products of reaction of fluorometallates with (i) dissolved or dispersed finely divided forms of metals and metalloid elements selected from the group of elements consisting of titanium, zirconium, hafnium, boron, aluminum, silicon, germanium, and tin and (ii) the oxides, hydroxides, and carbonates of said group of elements; water-soluble polymers and copolymers; polymers of the diglycidylether of bisphenol-A, optionally capped on the ends with non-polymerizable groups and/or having some of the epoxy groups hydrolyzed to hydroxyl groups; polymers and copolymers of acrylic and methacrylic acids and their salts, esters, amides, and nitrites; hexavalent chromium; and water soluble oxides, carbonates, or hydroxides of at least one of Ti, Zr, Hf, B, Al, Si, Ge, and Sn.

Contact between a first treatment liquid used as described above in the first essential operation of a process according to the invention and the metal substrate being treated in said process according to the invention can be achieved by any convenient method or combination of methods. Immersion and spraying, for example, are both capable of giving completely satisfactory results. The first treatment liquid is preferably maintained during its contact with the substrate to be treated at a temperature that is at least, with increasing preference in the order given, 30, 35, 38, 41, 43, 45, 47, or 49° C. and independently, at least for economy, preferably is not more than, with increasing preference in the order given, 90, 80, 70, 65, 60, 57, 55, 53, or 51° C. The time of contact between the first treatment liquid and the metal surface being treated in the first essential operation of a process according to the invention preferably is at least, with increasing preference in the order given, 0.2, 0.4, 0.6, 0.8, 1.0, 1.2, 1.4, 1.6, 1.8, or 2.0 minutes (hereinafter usually abbreviated as "min") and independently, at least for economy of operation, preferably is not more than, with increasing preference in the order given, 30, 20,10, 8, 6, 5.0, 4.0, 3.0, or 2.2 min.

After the first essential operation of a process according to the invention and before the second essential operation of such a process, the surface of a metal substrate as modified by the first operation is preferably rinsed with water. Independently the surface of a substrate modified by a first essential operation in a process according to the invention preferably is not dried or allowed to dry before being brought into contact with a second treatment liquid in the second essential operation of a process according to the invention.

The second essential operation of a process according to this invention is contacting the surface of a metal substrate that has already been modified by contact in the first essential operation of a process according to the invention as described above with a second treatment liquid comprising, preferably consisting essentially of, or more preferably consisting of, water, vanadate ions, and the cations necessary to balance the electrical charge of the vanadate ions. Preferably, these cations are alkali metal and/or ammonium ions, because most other vanadates are insufficiently soluble in water. Vanadates of any degree of aggregation may be used, but decavanadates are most preferred. "Decavanadates" should be understood herein to include not only ions with the chemical formula $V_{10}O_{28}^{-6}$ which are present in salts but protonated derivatives thereof having the general formula $V_{10}O_{(28-i)}(OH)_i^{-(6-i)}$, where i represents an integer from one to four, which are believed to be the predominant species present in aqueous solutions with a pH from 2 to 6. Cf. F. A. Cotton and G. Wilkinson, *Advanced Inorganic Chemistry*, 4th Ed., (John Wiley & Sons, New York, 1980), p. 712. Sodium ammonium decavanadate with the chemical formula $Na_2(NH_4)_4V_{10}O_{28}$ is currently most particularly preferred as a source of decavanadate ions for a second treatment liquid as described above in the second essential operation of a process according to this invention, because this salt is the least costly commercially available source of decavanadate ions.

The concentration of vanadium atoms present in vanadate ions in a second treatment liquid used in the second essential operation of a process according to this invention preferably is at least, with increasing preference in the order given, 0.02, 0.04, 0.06, 0.08, 0.10, 0.14, 0.17, 0.20, 0.22, 0.24, 0.26, 0.28, or 0.30 moles of vanadium atoms per kilogram of total second treatment liquid (this concentration unit being hereinafter usually abbreviated as "M/kg") and independently, at least for economy, preferably is not more than, with increasing preference in the order given, 3.0, 2.0,1.0, 0.80, 0.70, 0.60, 0.54, 0.49, 0.44, 0.40, 0.37, 0.35, 0.33, or 0.31 M/kg.

As in the first essential operation of a process according to the invention, contact between the metal substrate surface being treated and the second treatment liquid may be established by any convenient method. The temperature of the secondary treatment liquid, during contact with the previously treated and optionally rinsed metal substrate surface as described above preferably is at least, with increasing preference in the order given, 30, 35, 40, 45, 48, 51, 53, 55, 57, or 59° C. and independently preferably is not more than, with increasing preference in the order given, 90, 80, 75, 72, 69, 67, 65, 63, or 61° C. At 60° C., the time of contact between the second treatment liquid used in the second essential operation of a process according to this invention and the previously treated and optionally intermediately treated metal substrate as described above preferably is at least, with increasing preference in the order given, 0.1, 0.3, 0.5, 0.7, 0.9, 1.1, 1.3, 1.5, 1.7, or 1.9 min and independently preferably is not more than, with increasing preference in the order given, primarily for reasons of economy, 60, 30, 15, 10, 8.0, 6.0, 5.0, 4.5, 4.0, 3.6, 3.2, 2.8, 2.5, 2.3, or 2.1 min. For other temperatures during treatment in the second necessary operation of a process according to this invention, shorter times are preferred at higher temperatures and longer times at lower temperatures.

For a variety of reasons, it is preferred that a second treatment liquid according to the invention as defined above should be substantially free from many ingredients used in compositions for similar purposes in the prior art. Specifically, it is increasingly preferred in the order given, independently for each preferably minimized component listed below, that a second treatment liquid used in the second essential operation of a process according to the invention should contain no more than 1.0, 0.35, 0.10, 0.08, 0.04, 0.02, 0.01, 0.001, or 0.0002, percent of any of the following constituents: hexavalent chromium, cyanide, nitrite ions, hydrogen peroxide, and tungsten in any anionic form.

After having completed the second necessary operation of a process according to the invention, the treated metal surfaces preferably are again rinsed before drying or being allowed to dry. If heat is used to accelerate drying, the temperature of the metal during drying preferably does not exceed, with increasing preference in the order given, 100, 85, 75, 66, or 60° C., in order to avoid damage to the protective quality of the coating formed by a process according to the invention.

After a process according to the invention has been completed on a metal substrate and the last treatment liquid of the process has been dried or otherwise removed, the treated substrate is usually ready for use. However, for appropriate uses, the corrosion protection of the metal substrate may be still further increased by painting over the surface formed by the process according to the invention.

The invention may be further appreciated by consideration of the following non-limiting working and comparison examples and test results.

Aluminum alloy substrates were treated according to the following process sequence:

1. Clean in a suitably formulated alkaline cleaner for aluminum, prepared with and according to the directions of a commercial supplier of concentrates for such cleaners for 2.0 min at 49° C.
2. Rinse with tap water.
3. Deoxidize in an aqueous solution of 12% $HNO_3$ in water at normal ambient human comfort temperature (i.e., 18–23° C.) for 2 min.
4. Rinse with tap water.
5. Form protective coating—see details below.
6. Rinse with deionized water and dry.

For Comparison Example 1, the protective coating was formed by treatment with solutions prepared from BONDERITE® 713 chromating concentrate, a commercial product of the Henkel Surface Technologies Division of Henkel Corporation, Madison Heights, Mich, according to the manufacturer's directions. This is a typical example of a high quality chromate conversion coating recommended for treating aluminum that is to be used without painting or similar protective treatment.

For both Comparison Example 2 and Example 1 according to the invention, the protective coating was applied in three sub-operations. In the first sub-operation (5.1), the substrate as prepared from the end of operation 4 was immersed for 2.0 min of contact with a solution in water of 0.12% of $H_2ZrF_6$, a sufficient amount of fluoride from other sources to give a weight ratio of fluorine to zirconium that was about 1.29, sufficient ammonia to bring the pH value to 4.0, and no other deliberately added ingredients for Example 1. For Comparison Example 2, the treatment liquid in this sub-operation 5.1 was the same, except that it also contained 0.17% of water soluble polymer made by reacting formaldehyde and N-methyl glucamine with poly-4-vinyl phenol. For both Example 1 and Comparison Example 2, the second sub-operation 5.2 was rinsing with tap water, and the third sub-operation was treatment with a solution containing 3.2% of sodium ammonium decavanadate in water for 2.0 min at 60° C.

Substrates according to Comparison Examples 1 and 2 and Example 3 were subjected to salt spray testing for 1000 hours according to American Society for Testing and Materials Procedure B-117 and to measurements of the contact angle of deionized water against the surface after testing. Results are shown in Table 1 below.

TABLE 1

| Identification | % White Rust Corrosion after Salt Spray Exposure | Contact Angle of Water, Degrees |
|---|---|---|
| Comparison Example 1 | 3 | 55 |
| Comparison Example 2 | 8 | 10 |
| Example 1 | <1 | 8 |

The results in Table 1 indicate the process according to the invention produces results that are superior to those of two methods of the established prior art in both corrosion resistance and hydrophilicity.

The invention claimed is:

1. A process for improving the corrosion resistance of a surface of a metal substrate which comprises:

(I) contacting the surface with a first treatment liquid consisting essentially of water and at least one fluorometallate to form a modified surface; and (II) contacting the modified surface with a second treatment liquid, different from the first treatment liquid, consisting essentially of water, vanadate anions, and counterions for the vanadate anions.

2. The process of claim 1 wherein the first treatment liquid contains from 0.7 to 100 mM/kg of fluorometallate anions and the second treatment liquid contains from 0.02 to 3.0 M/kg of vanadium atoms present as vanadate ions.

3. The process of claim 2 wherein the first treatment liquid contains at least one of hydrofluoric acid and water soluble salts of hydrofluoric acid in an amount sufficient to reduce the rate of decomposition of the fluorometallate.

4. The process of claim 3 wherein an overall F:T ratio is from 6.02:1 to 9:1.

5. The process of claim 4 wherein pH of the first treatment liquid is from 1.0 to 8.0.

6. The process of claim 5 wherein the pH of the first treatment liquids from 2.0 to 6.0.

7. The process of claim 4 wherein a temperature of the first treatment liquid is from 30° C. to 90° C. and the substrate is contacted with the first treatment liquid for 0.2 to 30 minutes and a temperature of the second treatment liquid is from 30° C. to 90° C. and the substrate is contacted with the second treatment liquid for from 0.1 to 60 minutes.

8. The process of claim 7 wherein the temperature of the first treatment liquid is from 38° C. to 80° C. and the substrate is contacted with the first treatment liquid for from 0.8 to 10 minutes and the second treatment liquid is at a temperature 40° C. to 80° C. and the modified surface is contacted with the second treatment liquid for from 0.5 to 15 minutes.

9. The process of claim 2 wherein after contact with the first treatment liquid the modified surface is rinsed with water, but not dried, before the modified surface is contacted with the second treatment liquid.

10. The process of claim 9 wherein the metal substrate is rinsed with water and dried after contact with the second treatment liquid.

11. The process of claim 2 wherein the first treatment liquid contains from 2.5 to 50 mM/kg of fluorometallate and the second treatment liquid contains from 0.08 to 1.0 M/kg of vanadium atoms present as vanadate ions.

12. The process of claim 11 wherein the first treatment liquid contains at least one of hydrofluoric acid and water soluble salts of hydrofluoric acid in an amount sufficient to reduce the rate of decomposition of the fluorometallate.

13. The process of claim 1 wherein the first treatment liquid is at a pH of from 3.4 to 5.0.

14. The process of claim 1 wherein the first treatment liquid has an F:T ratio of from 6.02:1 to 9:1.

15. The process of claim 14 wherein the F:T ratio is from 6.06:1 to 7:5:1.

16. The process of claim 12 wherein the first treatment liquid has an F:T ratio of from 6.02:1 to 8:1.

17. The process of claim 1 wherein the surface of the metal substrate comprises at least one member selected from the group consisting of zinc, aluminum, magnesium, zinc alloys, aluminum alloys and magnesium alloys.

18. The process of claim 1 wherein the first treatment liquid contains from 2.5 to 50 mM/kg of fluorometallate and contains no more than 1.0 percent of any element having an atomic number that is greater than 14, except for an element that is part of the fluorometallate; and the second treatment liquid contains from 0.08 to 1.0 M/kg of vanadium atoms present as vanadate ions.

19. The process of claim 18 wherein the first treatment liquid further comprises acidizing and/or alkalinizing agent as needed to result in a pH value for the first treatment liquid that is 1.0 to 8.0, and the second treatment liquid comprises sodium ammonium decavanadate.

20. An article of manufacture of the process of claim 1.

21. An article of manufacture of the process of claim 12.

* * * * *

UNITED STATES PATENT AND TRADEMARK OFFICE

CERTIFICATE OF CORRECTION

PATENT NO. : 7,175,882 B2
APPLICATION NO. : 10/398002
DATED : February 13, 2007
INVENTOR(S) : Dolan et al.

It is certified that error appears in the above-identified patent and that said Letters Patent is hereby corrected as shown below:

Column 8

Line 1, insert --the-- between “wherein” and “pH.”
Line 4, insert --is-- between “liquids” and “from.”
Line 15, insert --from-- between “temperature” and “40°.”

Signed and Sealed this

Tenth Day of April, 2007

JON W. DUDAS
*Director of the United States Patent and Trademark Office*